US006326924B1

(12) United States Patent
Muramoto et al.

(10) Patent No.: US 6,326,924 B1
(45) Date of Patent: Dec. 4, 2001

(54) POLARIZATION DIVERSITY ANTENNA SYSTEM FOR CELLULAR TELEPHONE

(75) Inventors: Mitsuru Muramoto; Naoki Onishi; Hirotaka Saito; Kanemi Sasaki, all of Tokyo (JP)

(73) Assignee: Kokusai Electric Co., Ltd., Tokyo (JP)

( * ) Notice: Subject to any disclaimer, the term of this patent is extended or adjusted under 35 U.S.C. 154(b) by 0 days.

(21) Appl. No.: 09/314,890

(22) Filed: May 19, 1999

(30) Foreign Application Priority Data

May 19, 1998 (JP) ..... 10-153981

(51) Int. Cl.[7] ..... H01Q 1/24

(52) U.S. Cl. ..... 343/702; 343/700 MS; 343/725

(58) Field of Search ..... 343/702, 700 MS, 343/725, 727, 728, 729, 730

(56) References Cited

U.S. PATENT DOCUMENTS 5,517,676 * 5/1996 Sekine et al. ..... 343/702
5,903,822 * 5/1999 Sekine et al. ..... 343/702
5,940,040 * 8/1999 Koyanagi et al. ..... 343/702
5,977,916 * 11/1999 Vannatta et al. ..... 343/702
6,031,503 * 2/2000 Preiss, II et al. ..... 343/702
6,061,024 * 5/2000 McGirr et al. ..... 343/700 MS

* cited by examiner

*Primary Examiner*—Don Wong
*Assistant Examiner*—Hoang Nguyen
(74) *Attorney, Agent, or Firm*—Pillsbury Winthrop LLP

(57) ABSTRACT

Radio communication systems, e.g. cellular telephones, have employed a space diversity antenna system which includes a plurality of antennas. In the space diversity antenna system for use in the cellular telephone, since two antennas are positioned adjoining each other, the space diversity effect cannot be adequately provided. To solve this problem, the polarization diversity antenna system according to this invention incorporates a first antenna, a second antenna, and a conductive board on which the second antenna is fixed at a given position, thus preventing the current flowing in the conductive board from causing the reception characteristic of the second antenna to deteriorate.

19 Claims, 13 Drawing Sheets

POLARIZATION DIVERSITY ANTENNA SYSTEM FOR CELLULAR TELEPHONE

This patent application claims priority based on a Japanese patent application, H10-153981 filed on May 19, 1998, the contents of which are incorporated herein by reference.

BACKGROUND OF THE INVENTION

1. Field of the Invention

The present invention relates to an antenna system for use in a mobile radio communication terminal such as a cellular telephone or a pager, and in particular to a polarization diversity antenna system used therefor.

2. Description of Related Art

Space diversity antenna schemes have been employed in radio communication systems e.g., mobile radio communication systems, to improve the reception capability of a receiver under conditions of fading. As is well-known, the space diversity scheme employs a plurality of antennas. A typical space diversity antenna system for a cellular telephone, for example, incorporates a whip antenna protruding from the body of the cellular telephone and a built-in antenna for space diversity. Since the base station managing the cellular telephone communicates therewith using vertical polarized waves, the two antennas are so positioned as to be capable of receiving vertical polarized waves. In particular, the built-in antenna is located in the upper portion of the body so as to receive the waves without interference by the hand of the user of the cellular telephone.

FIG. 1 schematically shows a conventional space diversity antenna system. The antenna is used in the 800 MHz band, for example. In FIG. 1, the space diversity antenna system incorporates a circuit board 10, a whip antenna 20, and a built-in antenna 30. The circuit board 10, on which integrated circuits and electric parts are assembled, is placed in the body of the cellular telephone. The whip antenna 20 is provided on the upper side of the body in the vertical direction, that is, in the Z direction. The built-in antenna 30 is positioned in the upper portion of the circuit board 10. The shape of the built-in antenna 30 is like inverted F so as to save space for installation, wherein the built-in antenna 30 is shown magnified in the dotted circle in the figure. Here, for example, the length of the whip antenna is 90 mm, the height of the body is 120 mm, and the width of the body is 35 mm, the width depending upon the wavelength of the radio wave. Further, the height, width, and depth of built-in antenna 30 are 5 mm, 35 mm, and 20 mm, respectively.

FIG. 2 shows the characteristics of the conventional space diversity antenna system of FIG. 1, wherein FIG. 2(A) shows the radiation pattern of the built-in antenna 30 and FIG. 2(B) shows the radiation pattern of the whip antenna 20 in the Y-Z area of FIG. 1. As shown in FIG. 2, both the built-in antenna 30 and the whip antenna 20 have such characteristics that the component θ strongly radiates horizontally, namely in the Y direction, while the component ϕ weakly radiates horizontally. Here, since transmission antenna systems and reception antenna systems are reversible, "to radiate" is equivalent to "to receive". To summarize, in FIG. 2, both the built-in antenna 30 and the whip antenna 20 have a strong directionality for a vertical polarized wave in the Y direction.

In the conventional space diversity antenna system, however, since the built-in antenna 30 is adjacent to the whip antenna 20, the two antennas fails to sufficiently yield the effect of space diversity. Two antennas so located also cause each other's characteristics to deteriorate due to the electromagnetic combination of the two antennas.

On the other hand, in addition to the space diversity system, the polarization diversity system is known. The polarization diversity system requires the built-in antenna 30 to receive polarized waves differing in directionality from the polarized waves received by the whip antenna 2, that is, to receive horizontal polarized waves. However, since the small body of the cellular telephone does not permit a large circuit board or a large ground plate for grounding, a large current is produced in the ground plate by the vertical radiated waves received by the ground plate. Accordingly, the characteristic of the built-in antenna 30 depends on a high-frequency current vertically flowing in the ground plate more than on the high-frequency current flowing in the built-in antenna 30 itself. In sum, the effect is that the current flowing in the ground plate prevents the built-in antenna 30 from being able to receive horizontal radiation.

FIG. 3 schematically shows a model of a polarization diversity antenna system with the built-in antenna placed horizontally, and FIG. 4 shows the characteristic of the built-in antenna. Although the built-in antenna 30 is placed horizontally, as shown in FIG. 4, the component θ strongly radiates horizontally, in approximately the same fashion as shown in the characteristic shown in FIG. 2(A). The reason why the direction of radiation of the built-in antenna 30 remains unchanged is that the built-in antenna 30 depends mainly on the high-frequency current vertically flowing in the circuit board 10. Consequently, the polarization diversity antenna system constructed as in FIG. 3 fails to provide the effect of polarization diversity.

SUMMARY OF THE INVENTION

Therefore, it is an object of the present invention to provide a polarization diversity antenna which overcomes the drawbacks in the related art.

According to an aspect of the present invention, there is provided a polarization diversity antenna system comprising: a first antenna which receives a first polarized wave; a second antenna which receives a second polarized wave perpendicular to the first polarized wave; and a conductive board on which the second antenna is provided, wherein the second antenna is provided in such a position that currents flowing in the conductive board which the conductive board produces upon receiving either the first polarized wave or the second polarized wave cancel each other out.

There is also provided a polarization diversity antenna system according to this aspect of the invention, wherein: the conductive board is rectangular, and the second antenna is provided symmetrically with respect to the center of the conductive board in the longitudinal direction of the conductive board.

There is also provided a polarization diversity antenna system according to this aspect of the invention, wherein the first antenna is provided on the conductive board symmetrically with respect to the center.

There is also provided a polarization diversity antenna system according to this aspect of the invention, wherein the second antenna has a built-in antenna.

There is also provided a polarization diversity antenna system according to this aspect of the invention, wherein the second antenna has an inverted F antenna.

There is also provided a polarization diversity antenna system according to this aspect of the invention, wherein the second antenna has an inverse L antenna.

There is also provided a polarization diversity antenna system according to this aspect of the invention, wherein the second antenna has a loop antenna.

According to another aspect of the present invention, there is provided a polarization diversity antenna system, wherein: the conductive board is rectangular, and the second antenna has a first antenna element and a second antenna element, the first antenna element and the second antenna element being provided on the conductive board symmetrically with respect of the center of the conductive board in the longitudinal direction of the conductive board.

There is also provided a polarization diversity antenna system according to this aspect of the invention, wherein the first and second antenna elements have substantially the same shape.

There is also provided a polarization diversity antenna system according to this aspect of the invention, wherein the second antenna has a built-in antenna.

There is also provided a polarization diversity antenna system according to this aspect of the invention, wherein the second antenna has an inverted F antenna.

There is also provided a polarization diversity antenna system according to this aspect of the invention, wherein the second antenna has an inverse L antenna.

There is also provided a polarization diversity antenna system according to this aspect of the invention, wherein the second antenna has a loop antenna.

According to still another aspect of the present invention, there is provided a polarization diversity antenna system comprising: an antenna which selectively receives either a first polarized wave or a second polarized wave, the antenna including a first antenna element and a second antenna element; and a conductive board on which the antenna is fixed, wherein the first antenna element and the second antenna element are arranged symmetrically with respect to the centerline of the conductive board.

There is also provided a polarization diversity antenna system according to this aspect of the invention, wherein: the conductive board is rectangular, and the first antenna element and the second antenna element are arranged symmetrically with respect to the center of the conductive board in the longitudinal direction of the conductive board.

According to still another aspect of the present invention, there is provided a polarization diversity antenna system for use in a portable telephone comprising: a whip antenna which receives vertical polarized waves; a built-in antenna which receives horizontal polarized waves; and a rectangular conductive board on which the built-in antenna is fixed, wherein the built-in antenna is provided in such a position that currents flowing in the rectangular conductive board which the rectangular board produces upon receiving one of the vertical polarized waves and the horizontal polarized waves cancel each other out.

According to still another aspect of the present invention, there is provided a polarization diversity antenna system for use in a portable telephone comprising: a whip antenna which receives vertical polarized waves; a built-in antenna which receives horizontal polarized waves; and a rectangular conductive board on which the built-in antenna is fixed, wherein the built-in antenna is provided symmetrically with respect to the centerline of the rectangular conductive board perpendicular to the long side of the rectangular conductive board.

According to still another aspect of the present invention, there is provided a portable telephone comprising: a whip antenna which receives vertical polarized waves; a built-in antenna which receives horizontal polarized waves; a rectangular conductive board on which the built-in antenna is fixed; and a receiving circuit which selectively receives either vertical polarized waves or horizontal polarized waves; and a switch circuit which selectively connects to the receiving circuit, one of the vertical polarized waves received by the whip antenna and the horizontal polarized waves received by the built-in antenna, wherein the built-in antenna is provided in such a position that currents flowing in the rectangular conductive board which the rectangular board produces upon receiving one of the vertical polarized waves and the horizontal polarized waves cancel each other out.

According to still another aspect of the present invention, there is provided a portable telephone comprising: a whip antenna which receives vertical polarized waves; a built-in antenna which receives horizontal polarized waves; a rectangular conductive board on which the built-in antenna is fixed; and a receiving circuit which selectively receives either vertical polarized waves or horizontal polarized waves; and a switch circuit which selectively connects to the receiving circuit, one of the vertical polarized waves received by the whip antenna and the horizontal polarized waves received by the built-in antenna, wherein the built-in antenna is provided symmetrically with respect to the centerline of the rectangular conductive board perpendicular to the long side of the rectangular conductive board.

BRIEF EXPLANATION OF THE DRAWINGS

The present invention will be understood more fully from the detailed description given below, in conjunction with the accompanying drawings.

DESCRIPTION OF THE PREFERRED EMBODIMENTS

The invention will now be described based on the preferred embodiments, which do not intend to limit the scope of the present invention, but exemplify the invention. All of the features and the combinations thereof described in the embodiment are not necessarily essential to the invention.

<First Embodiment>

The first embodiment of the polarization diversity antenna system will now be described. The principal feature of the first embodiment is that the built-in antenna is provided in the center of the circuit board in the longitudinal direction, that is to say, horizontally. This enables the current flowing between the upper side of the circuit board and the built-in antenna and the current flowing between the lower side of the circuit board and the built-in antenna to cancel each other out, which reduces or eliminates the influence of the current flowing in the circuit board upon the characteristic of the built-in antenna.

Figure 5:
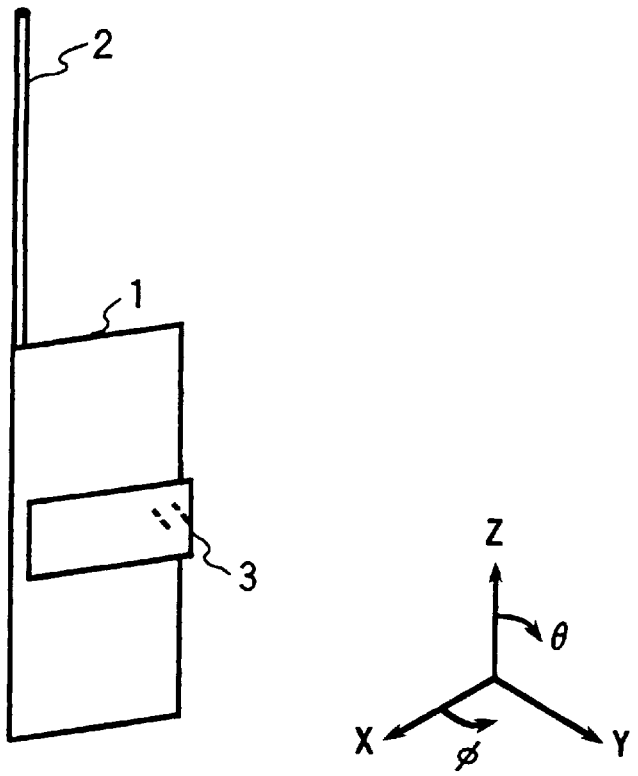
FIG. 5 shows the structure of the first embodiment of the polarization diversity antenna system.
Figure 6:
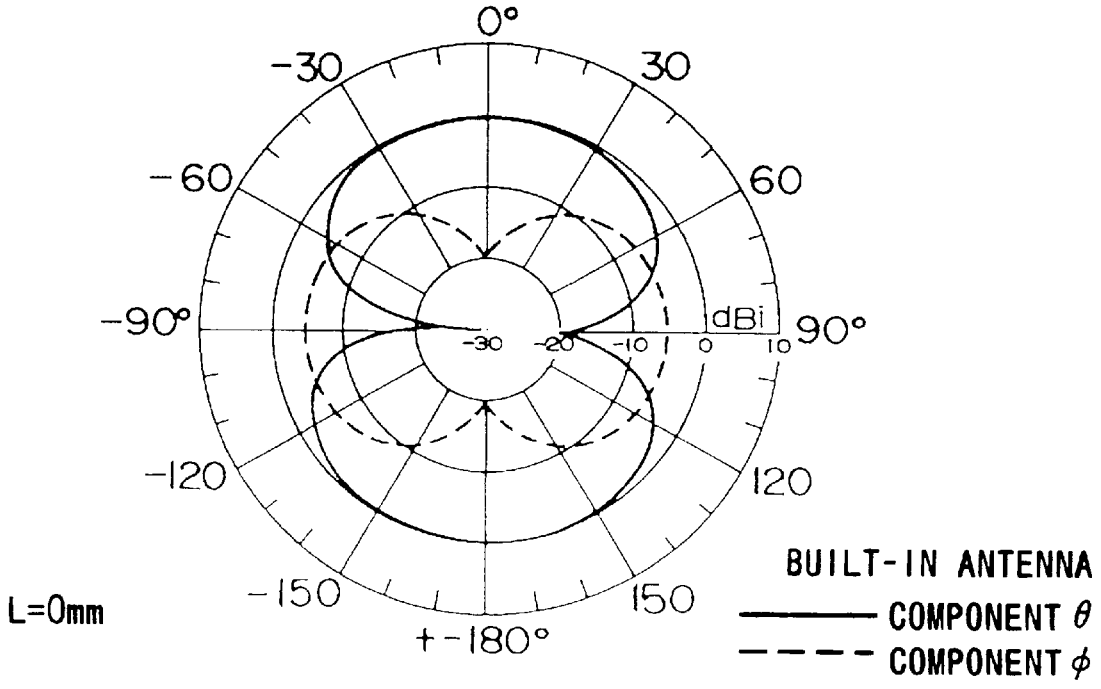
FIG. 6 shows the radiation pattern of the built-in antenna of the first embodiment.

FIG. 5 schematically shows the first embodiment of the polarization diversity antenna system, and FIG. 6 shows the radiation pattern of the built-in antenna. As shown in FIG. 5, the polarization diversity antenna system incorporates a circuit board 1, a whip antenna 2, and an built-in antenna 3. The circuit board 1 includes several integrated circuits, electric parts, and printed wiring which permits current to flow in the circuit board 1. The whip antenna 2 is provided on an end of the circuit board 1 while the built-in antenna 3 is provided around the center of the circuit board 1 in the longitudinal direction. Since the whip antenna 2 expands vertically, it receives vertical radiated waves; on the contrary, since the built-in antenna 3 expands horizontally, it receives horizontal radiated waves. The built-in antenna 3 divides the current flowing in the circuit board 1 into two parts.

Figure 1:
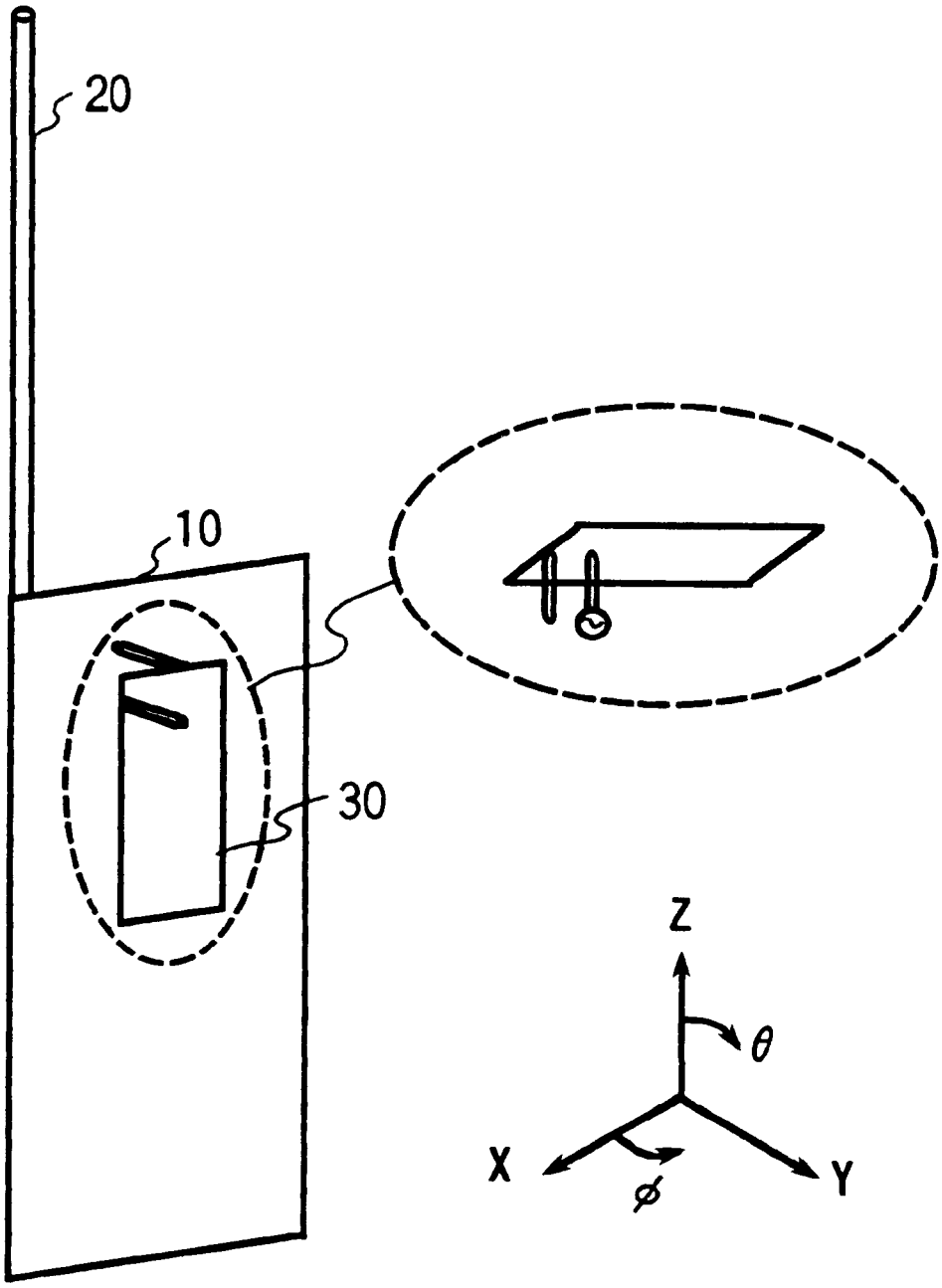
PRIOR ART FIG. 1
FIG. 1 shows the structure of a conventional space diversity antenna system.
Figure 2A:
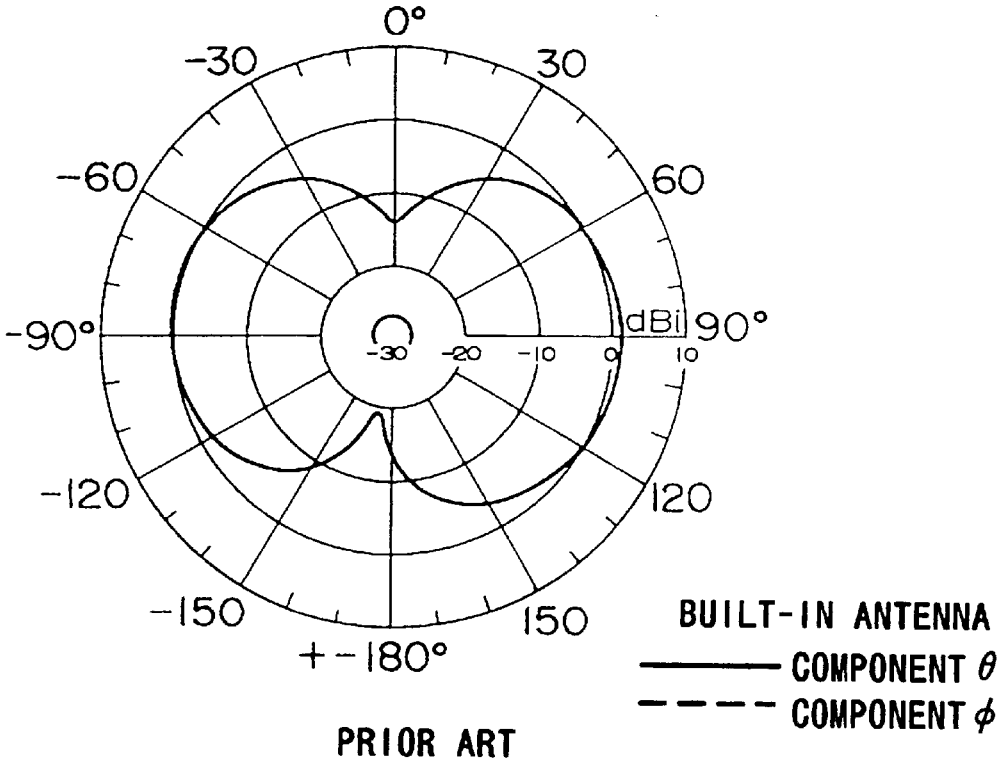
PRIOR ART FIG. 2(A)
FIGS. 2(A) and 2(B) respectively show the radiation pattern of the built-in antenna and the radiation pattern of the whip antenna of the conventional space diversity antenna system.
Figure 2B:
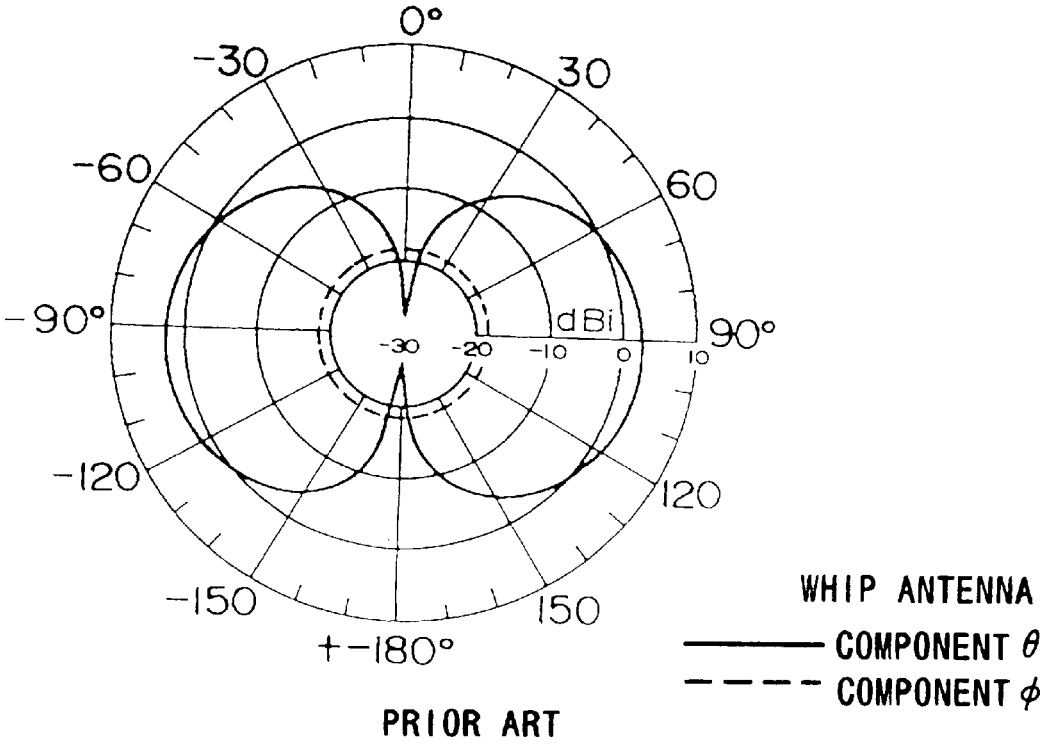
PRIOR ART FIG. 2(B)
Figure 3:
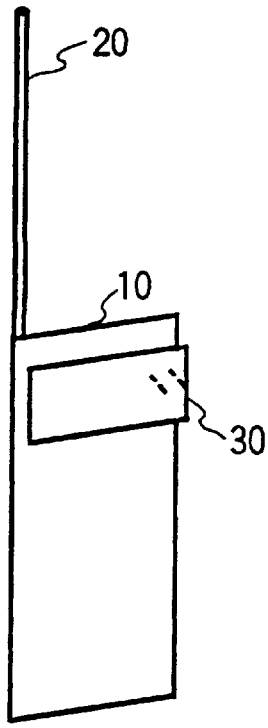
PRIOR ART FIG. 3
FIG. 3 shows the structure of an example of a polarization diversity antenna system.

Specifically, the radio wave received by the circuit board 1 yields a current on the circuit board 1; however, the built-in antenna 3, being laid around the middle of the circuit board 1, divides the current into two parts. Further, the first part of the current and the second part of the current flow in directions opposite to each other. As a result, the influence of the first part upon the built-in antenna 3 and the influence of the second part upon the built-in antenna 3 cancel each other out. As shown in FIG. 6, the component $\phi$ remarkably strongly radiates horizontally, that is, in the Y direction, which differs extremely from the conventional radiation of FIG. 2. To sum up, the whip antenna 2 receives vertical polarized waves in the Y direction as shown in FIG. 2(B) while the built-in antenna 3 receives horizontal polarized waves in the Y direction as shown in FIG. 6. Besides, the whip antenna 2 does not receive radio waves in the Z direction; however, the built-in antenna 3 receives radio waves in the Z direction.

Figure 4:
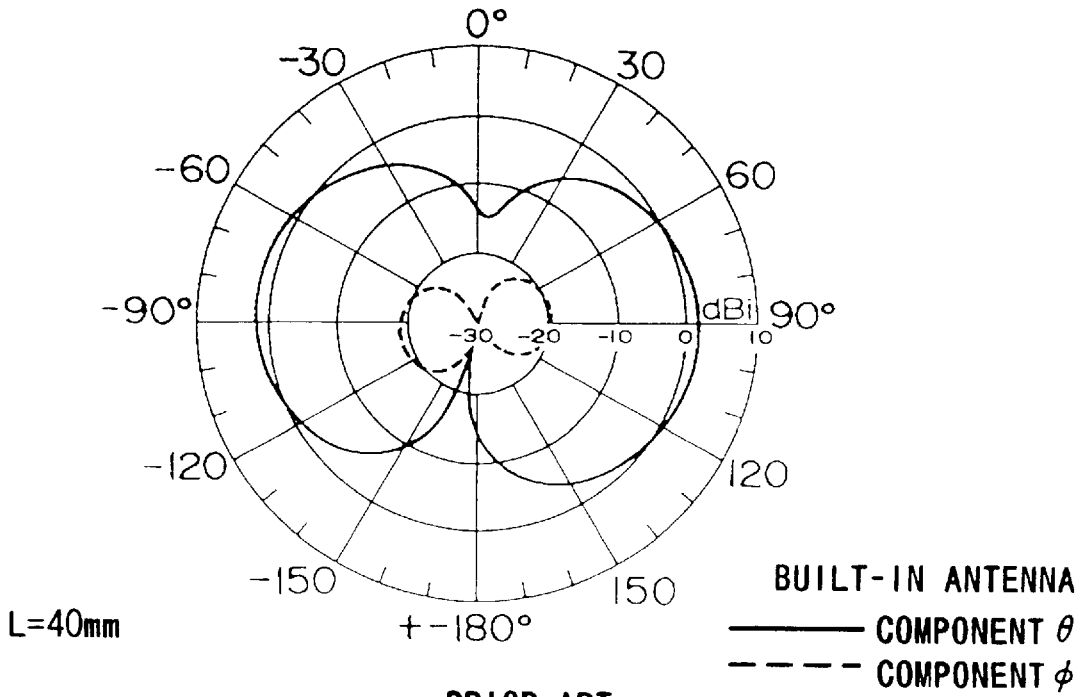
PRIOR ART FIG. 4
FIG. 4 shows the radiation pattern of the polarization diversity antenna system of FIG. 3.
Figure 7:
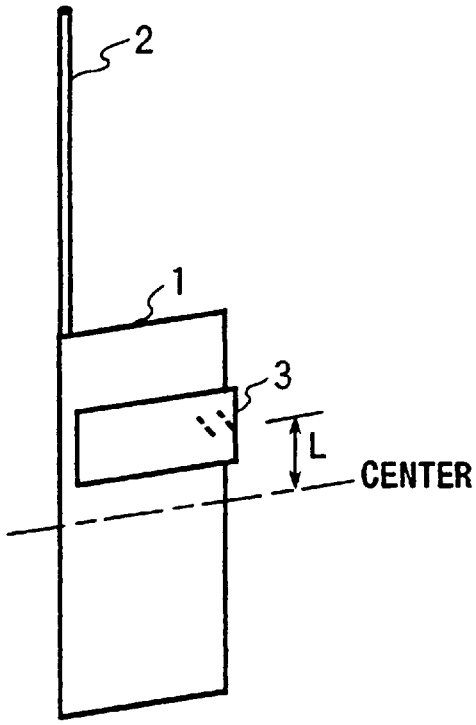
FIG. 7 shows the specification of the position of the built-in antenna of the first embodiment.
Figure 8A:
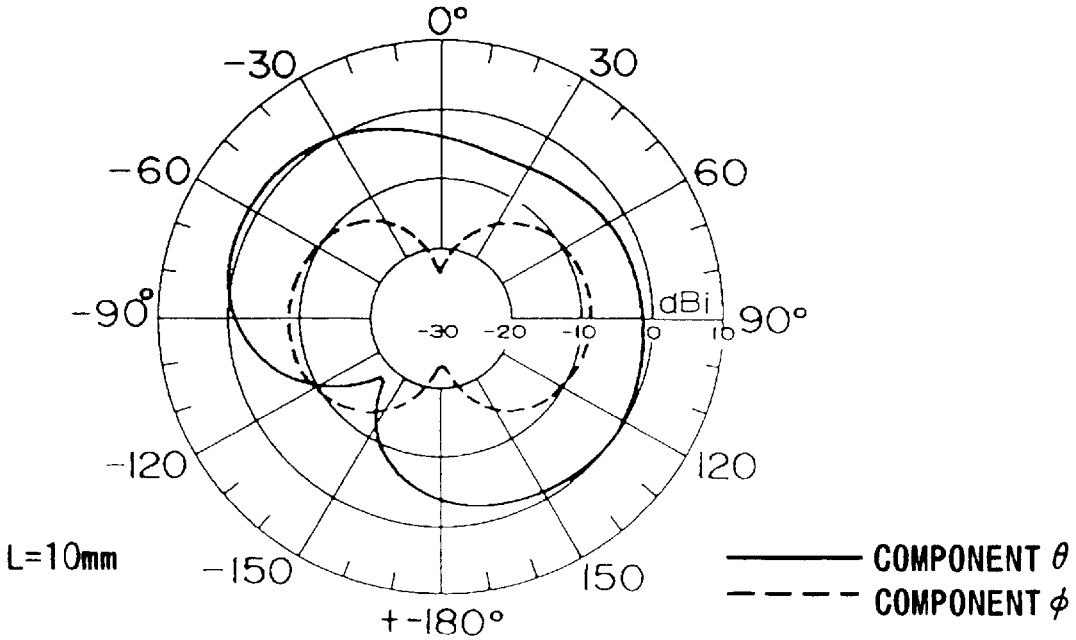
FIGS. 8(A)–8(C) show the radiation patterns of the built-in antenna of the first embodiment where the length (h) denoting the distance between the center of the circuit board and the position of the built-in antenna=10, 20, and 30 mm, respectively.
Figure 8B:
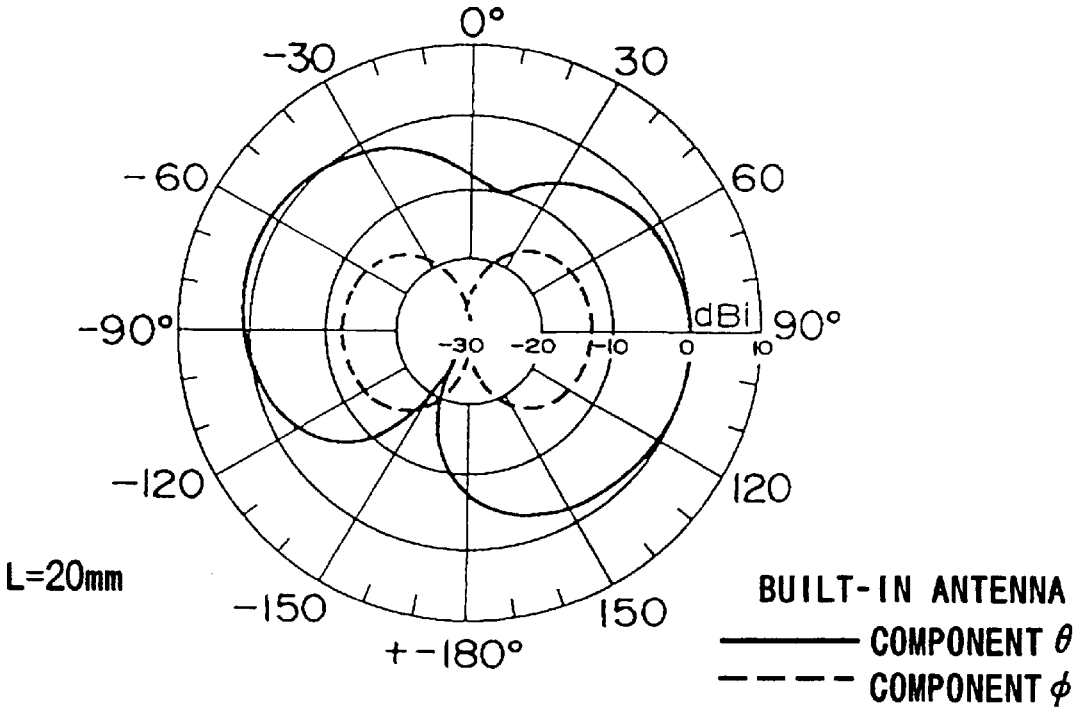
Figure 8C:
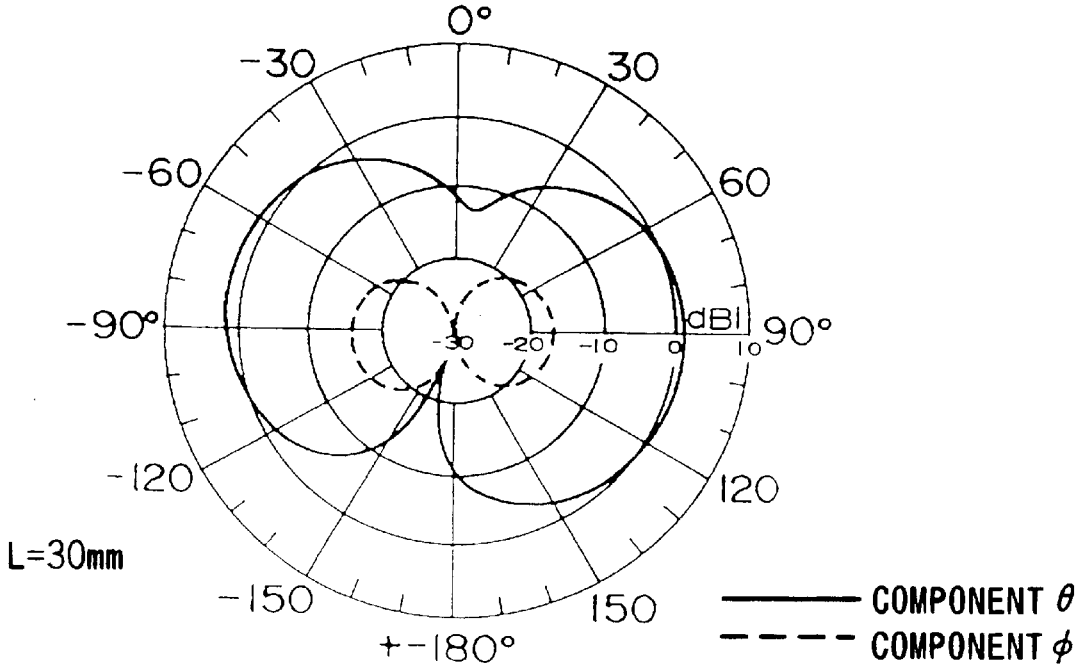

FIG. 7 is an explanatory diagram showing the attachment position of the built-in antenna on the circuit board, in which the length "L" is indicative of the attachment positions of the built-in antenna. FIG. 8 shows the radiation patterns wherein FIG. 8(A) shows the radiation pattern where the length L=10 mm, FIG. 8(B) shows the radiation pattern where the length L=20 mm, and FIG. 8(C) shows the radiation pattern with the length L=30 mm. Similarly, FIG. 6 shows the radiation pattern with the length L=0 mm and FIG. 4 shows the radiation pattern with the length L=40 mm. Here, the length L denotes the distance between the center of the circuit board 1 and the position of the built-in antenna 3. As these radiation patterns illustrate, the built-in antenna 3 with a longer length L radiates in similar fashion to the whip antenna 2, that is to say, the characteristic of the built-in antenna 3 becomes worse as a polarization antenna, because the current flowing in the circuit board 1 increases in accordance with the length L. In conclusion, the built-in antenna 3, when removed from the center of the circuit board 1 by a distance equal to less than 15% of the longitudinal length of the circuit board 1, can provide a large polarization diversity effect.

The above embodiment employs the built-in antenna 3 as the built-in antenna; however, it is also possible to employ a loop antenna, an inverse L antenna, or a modification of one of these antennas as the built-in antenna. Further, in lieu of providing the whip antenna 2 on the end of the circuit board 1, it is possible to provide an antenna acting as the whip antenna 2 in the upper and lower portions of the circuit board 1.

As described above, according to the first embodiment, since the built-in antenna 3 used for polarization diversity in cooperation with the whip antenna 2 is placed at the center line of the circuit board 1 or , more specifically, since the built-in antenna 3 is positioned symmetrically with respect to the center line of the circuit board 1, the built-in antenna 3 divides the current flowing in the circuit board 1 into two parts. As a result, the influences of these two parts of the current upon the built-in antenna 3 are reduced or cancelled out by each other, which enables the built-in antenna 3 to act as a polarization diversity antenna receiving vertical polarized waves.

<Second Embodiment>

The second embodiment of the polarization diversity antenna system according to the present invention will be now explained.

Figure 9:
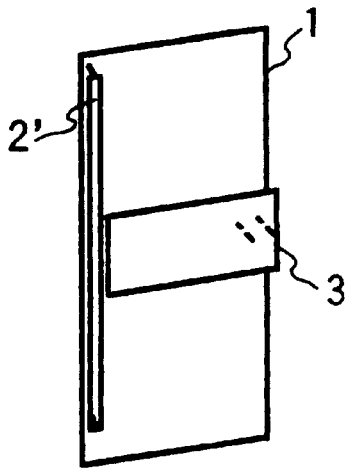
FIG. 9 shows the structure of the second embodiment of the polarization diversity antenna system.

FIG. 9 schematically shows the structure of the second embodiment of the polarization diversity antenna system. As shown in the figure, in contrast with the first embodiment where the whip antenna 2 was positioned on the end of the circuit board 1, here a whip antenna 2' serving as the whip antenna 2 is positioned in the circuit board 1. More specifically, in the circuit board 1, the antenna 2' is placed vertically along the long side of the circuit board 1 and is placed symmetrically with respect to the center line of the circuit board 1. Consequently, the whip antenna 2' and the built-in antenna 3 are at right angles with each other.

As described above, according to the second embodiment, in contrast to the first embodiment, the whip antenna 2' acting as the whip antenna 2 is vertically positioned in the circuit board 1, more specifically, is placed abutting the long side of the circuit board 1 and symmetrically about the horizontal centerline of the circuit board 1. Therefore, in addition to providing an effect similar to that of the first embodiment, the second embodiment allows the size of the polarization diversity antenna system to be smaller than in the first embodiment.

<Third Embodiment>

The third embodiment of the polarization diversity antenna system according to the present invention will now be described.

Figure 10:
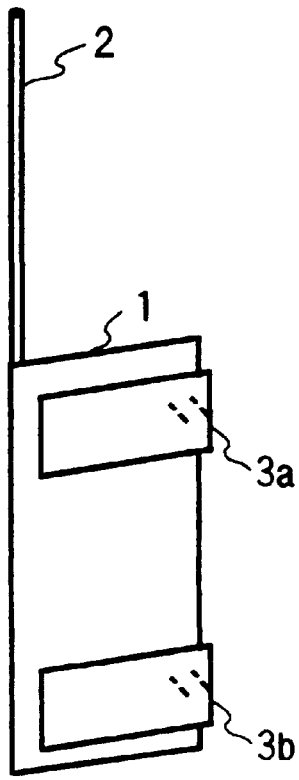
FIG. 10 shows the structure of the third embodiment of the polarization diversity antenna system.
Figure 11:
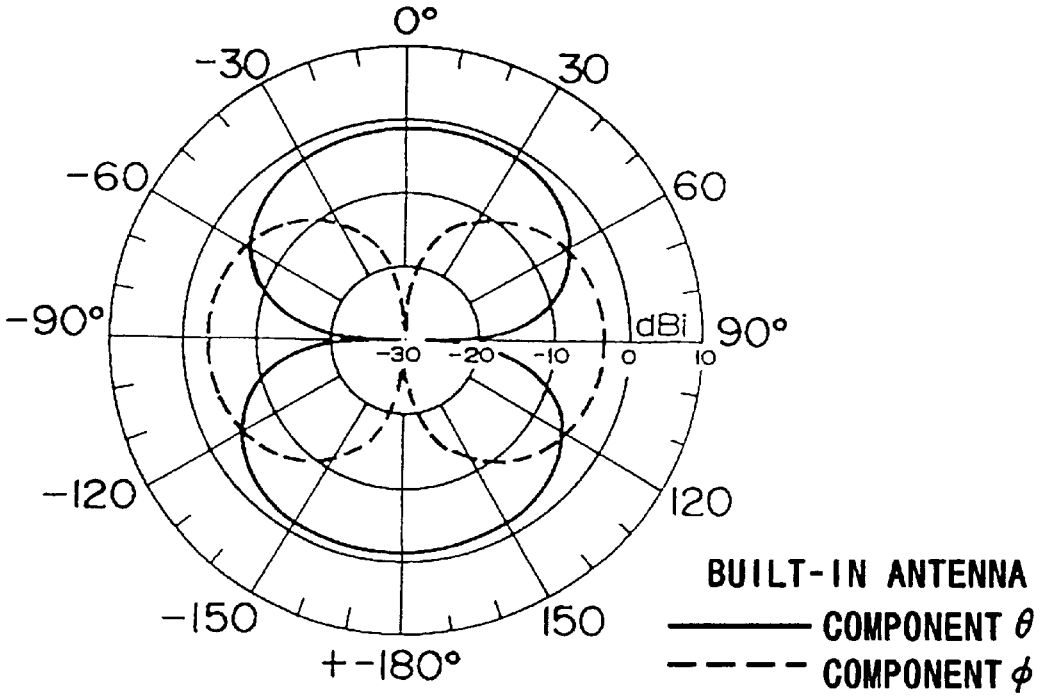
FIG. 11 shows the radiation pattern of the built-in antenna of the third embodiment.

FIG. 10 schematically shows the structure of the third embodiment. As shown in the figure, the built-in antenna 3 incorporates a first built-in antenna element 3*a* and a second built-in antenna element 3*b*. The first built-in antenna element 3*a* is horizontally placed in the upper portion of the circuit board 1 while the second built-in antenna element 3*b* is horizontally placed in the lower portion of the circuit board 1 so that the built-in antenna 3 receives polarized waves whose directionality is opposite to the polarized waves received by the whip antenna 2. More specifically, the built-in antenna 3 can receive the polarized waves when both the first built-in antenna element 3*a* and the second built-in antenna element 3*b* are fed, that is, work. FIG. 11 shows the radiation pattern of the built-in antenna 3 shown in FIG. 10.

Upon receipt of a horizontal radiated wave, the circuit board 1 allows a current to flow in the portions of the circuit board 1 divided by the first and second built-in antenna elements 3*a* and 3*b*. These currents cancel each other out, whereby both the first built-in antenna element 3*a* and the second built-in antenna element 3*b* is free from the influences of these currents. As shown in FIG. 11, the radiation characteristic of the built-in antenna 3 is similar to that of the first embodiment shown in FIG. 6, which favors the polarization diversity antenna system.

As described above, the first and second built-in antenna elements 3*a* and 3*b* are positioned in the upper and lower portions, respectively, of the circuit board 1. In addition, the first and second built-in antenna elements 3*a* and 3*b* are preferably positioned at the same distance from the horizontal center line of the circuit board 1. That is to say, the first and second antenna elements 3*a* and 3*b* are preferably positioned symmetrically with respect to the horizontal centerline of the circuit board 1 in such a fashion that the currents flowing in the circuit board 1 cancel each other out. Moreover, the first and second built-in antenna elements 3*a* and 3*b* are preferably identical in shape so as to have the same radiation characteristic.

As explained above, according to the third embodiment, the built-in antenna 3 comprising the first built-in antenna element 3*a* and the second built-in antenna element 3*b* can also provide a larger polarization diversity effect than can the prior art.

<Fourth Embodiment>

The fourth embodiment of the polarization diversity antenna system according to the present invention will now be described.

Figure 12:
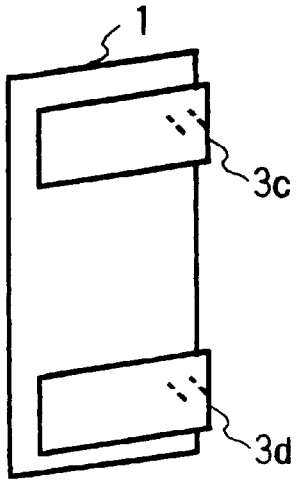
FIG. 12 shows the structure of the fourth embodiment of the polarization diversity antenna system.
Figure 13A:
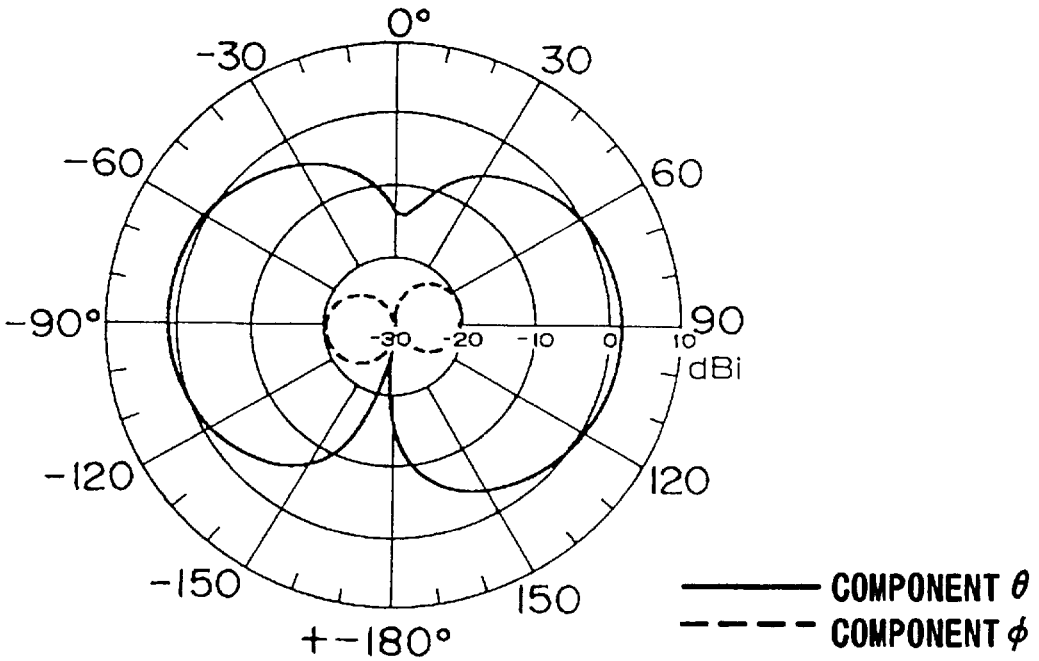
FIG. 13(A) shows the radiation pattern of one of the two built-in antenna elements of the fourth embodiment.
Figure 13B:
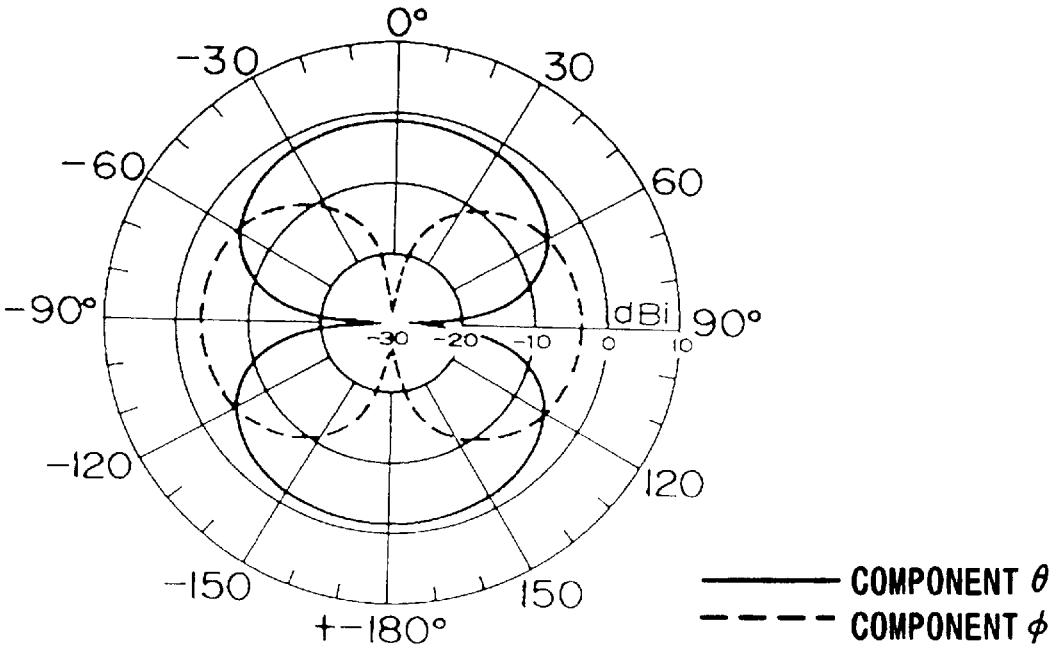
FIG. 13(B) shows the radiation pattern of the combination of the two built-in antenna elements of the fourth embodiment.
Figure 14A:
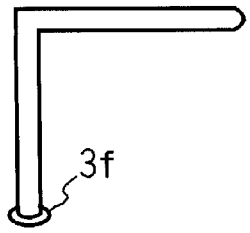
FIG. 14(A) shows the structure of an inverse L antenna.
Figure 14B:
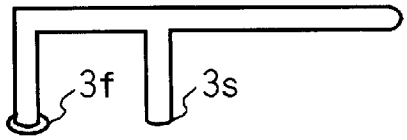
FIG. 14(B) shows the structure of an inverted F antenna.
Figure 14C:
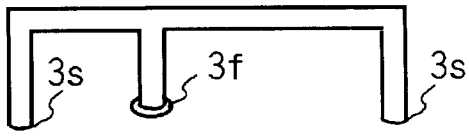
FIG. 14(C) shows the structure of a M-shaped antenna.
Figure 14D:
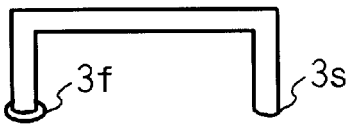
FIG. 14(D) shows the structure of a loop antenna.

FIG. 12 schematically shows the structure of the fourth embodiment, FIG. 13(A) shows the radiation pattern of one of the two built-in antenna elements, and FIG. 13(B) shows the radiation pattern of the combination of the two built-in antenna elements. As shown in FIG. 12, the fourth embodiment of the polarization diversity antenna system has no whip antenna. However, the built-in antenna 3 incorporates two built-in antenna elements 3*c* and 3*d* as in the third embodiment. If one of the built-in antenna elements 3*c* and 3*d* is fed, the built-in antenna 3 can receive vertical polarized waves; on the contrary, if both of them are fed, the built-in antenna 3 can receive horizontal polarized wave. Specifically, if only one of the two built-in antenna elements 3*c* and 3*d* receives polarized waves, a large current flows in the circuit board 1. As a result, as shown in FIG. 13(A) , the component θ radiates strongly while the component ϕ radiates weakly, like the radiation pattern of the conventional built-in antenna 30 shown in FIG. 4, which favors receiving vertical polarized waves. On the contrary, if both of the two inverted F antenna elements 3*c* and 3*d* receive polarized waves, as shown in FIG. 13(B), the component θ radiates strongly while the component ϕ also radiates strongly, like the radiation pattern of the built-in antenna of the first embodiment shown in FIG. 6, which favors receiving horizontal polarized waves.

A s described above, according to the fourth embodiment, the built-in antenna 3 incorporates two built-in antenna elements 3*c* and 3*d*, wherein the use of one of these two antenna elements provides for the reception of vertical polarized waves and the use of both provides for the reception of horizontal polarized waves.

FIGS. 14(A–D) show examples of antennas capable of serving as the built-in antenna 3, wherein the feeding point 3*f* is used for feeding of each antenna while the short point 3*s* is used for establishing of short-circuit. The above embodiments employ the planar inverted F antenna as the built-in antenna 3; as shown in FIGS. 14(A–D), however, it is possible to employ an inverse L antenna, an inverted F antenna, an M-shaped antenna, a loop antenna, or a modification of one of these antennas as the built-in antenna 3. In contrast with the shape of the planar inverted F antenna, all of them are bar-shaped. Even though the planar inverted F antenna is a modification of the inverted F antenna of FIGS. 14(A–D) (B), all of those antennas of FIG. 14 can provide the same effect as described above.

Figure 15:
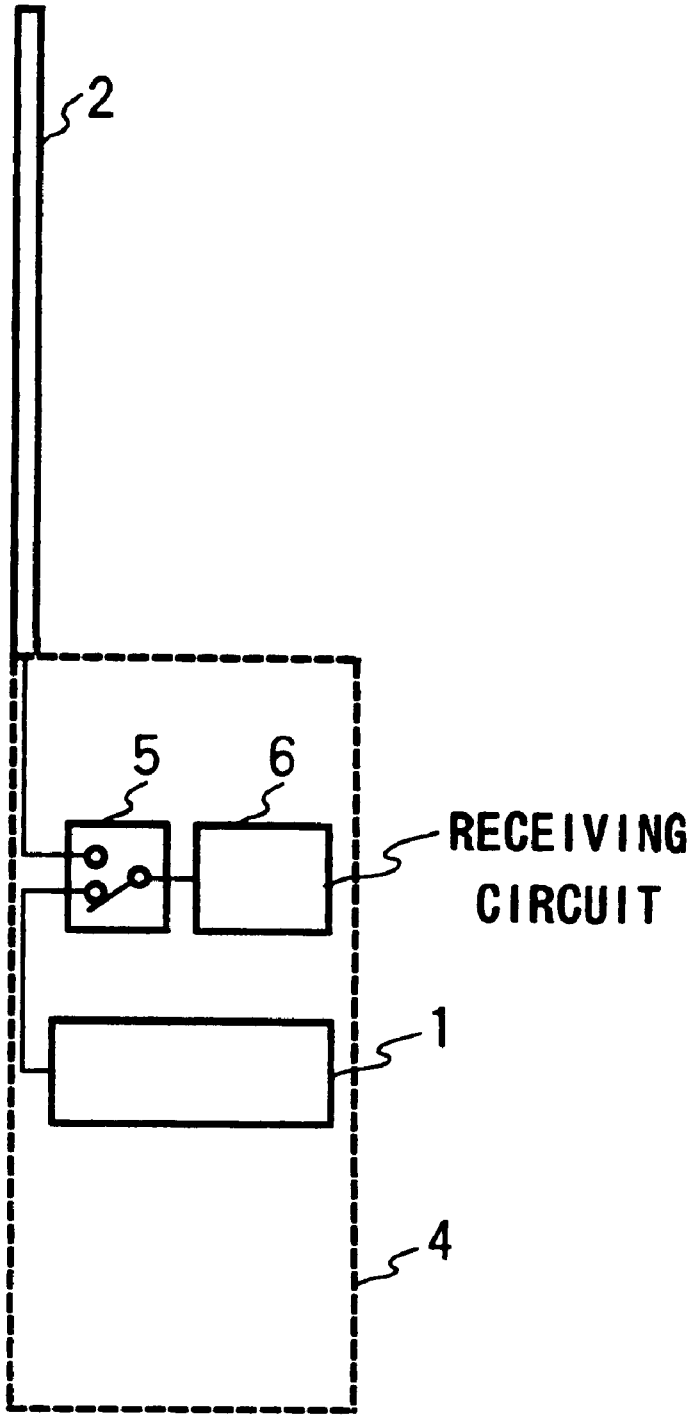
FIG. 15 shows the structure of a portable telephone in which the polarized diversity antenna system according to the present invention is installed.

As shown in FIG. 15, the polarization diversity antenna system works well in a portable telephone or a PHS, which have less room for the circuit board. In the figure, the portable telephone 4 incorporates a whip antenna 2, a built-in antenna 4, a switch 5, and a receiving circuit 6, wherein the switch 5 selects either the current produced in the whip antenna 2 or the current produce in the built-in antenna 1 and gives the selected current to th e receiving circuit 6. As described above, since the current produced in the built-in antenna 1 can flow free from the influence of the current flowing in the circuit board, the portable telephone 4 is provided with the effect of the polarization diversity antenna system.

Figure 16:
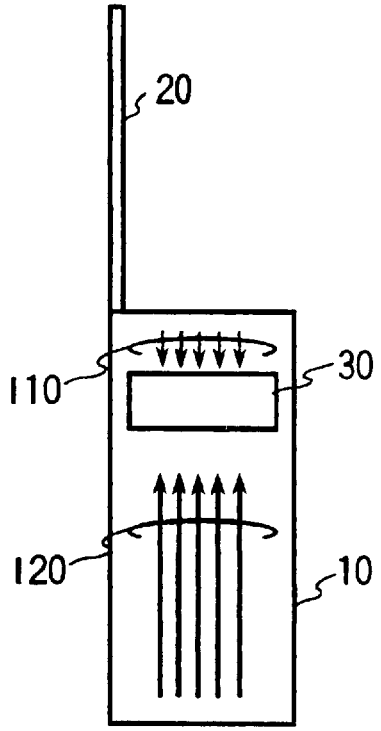
PRIOR ART FIG. 16
FIG. 16 shows the currents flowing in the circuit board in the conventional polarization antenna system.

As described above, in the conventional polarization diversity antenna system, the characteristic of the circuit board 10 is such that a small current I10 and a large current I20 flow in the circuit board 10 toward the built-in antenna 30 as shown in FIG. 16. Accordingly, as for transmission of waves, such an imbalance between the currents I10 and I20 changes the characteristic of the built-in antenna 30, such that the built-in antenna 30 can not transmit vertical polarized waves. Since transmission antennas and reception antennas are reversible, such an imbalance also prevents the built-in antenna 30 from receiving vertical polarized waves.

Figure 17:
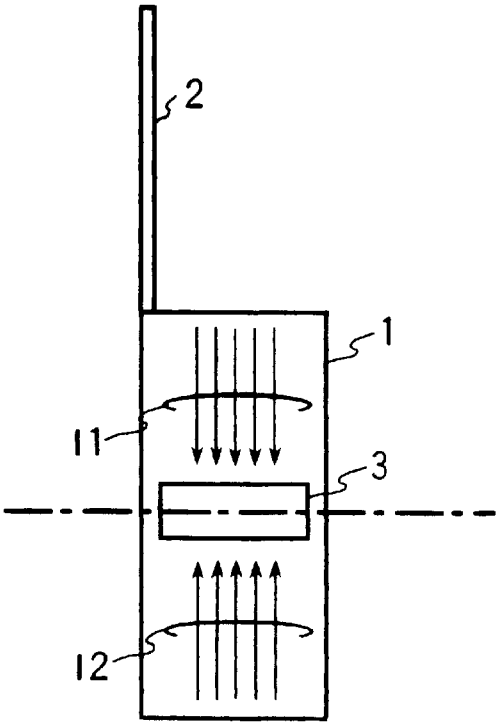
FIG. 17 shows the currents flowing in the circuit board in the polarization diversity antenna system according to the first embodiment.

In contrast, according to the present invention, since the built-in antenna 3 is provided symmetrically with respect to the centerline of the circuit board 3, there flow currents I1 and I2 whose amounts are the same but whose directions are opposite to each other as shown in FIG. 17. Therefore, these currents I1 and I2 cancel each other out. Such a cancellation or balance enables the built-in antenna 3 to receive vertical polarized waves.

Figure 18:
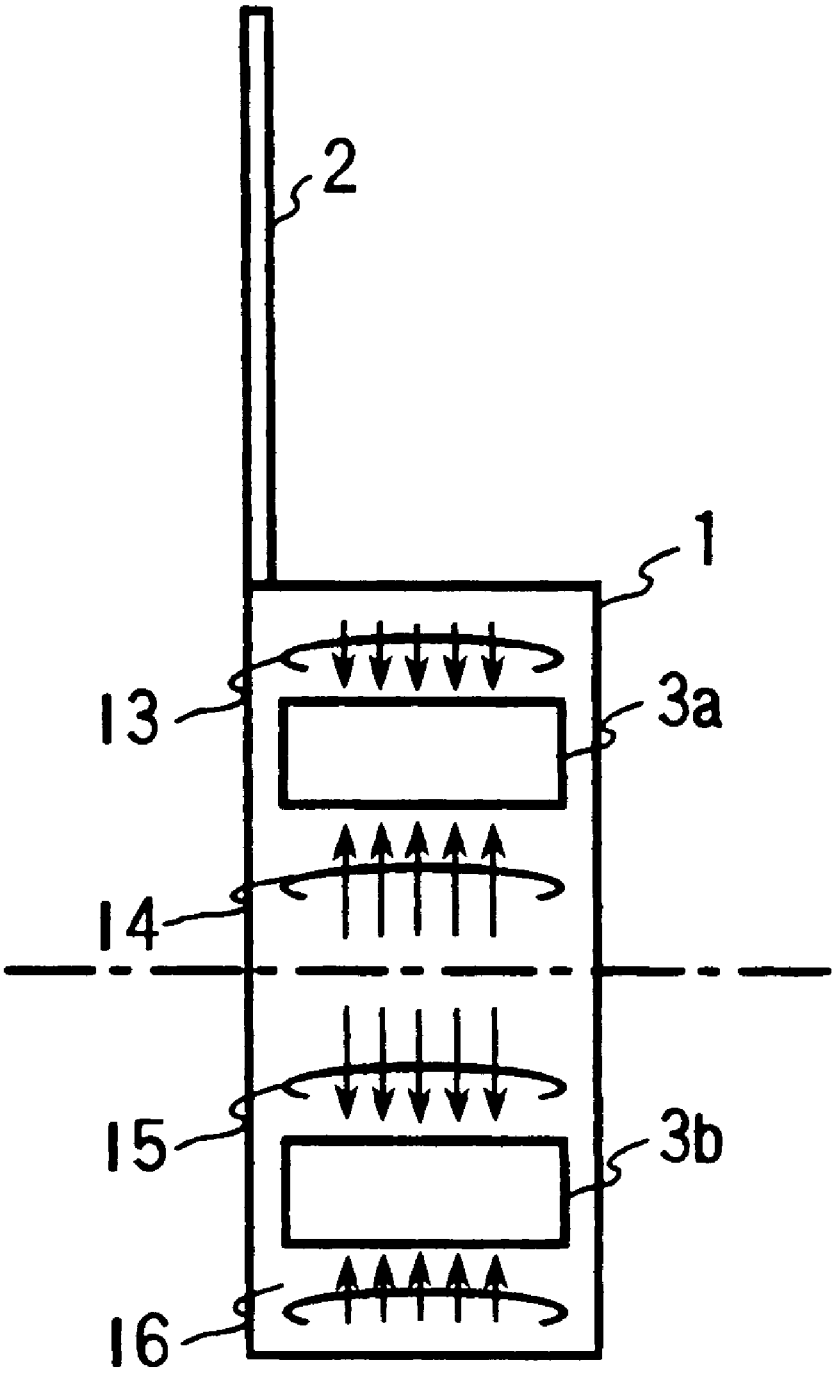
FIG. 18 shows the currents flowing in the circuit board in the polarization diversity antenna system according to the third embodiment.

Similarly, since the built-in antenna elements 3*a* and 3*b* of the third and fourth embodiments are provided symmetrically with respect to the centerline of the circuit board 3, there flow currents I3, I4, I5, and I6 as shown in FIG. 18. Specifically, the current I3 and the current I6 cancel each other out while the current I4 and the current I5 cancel each other out. This cancellation allows the built-in antenna 3 to receive vertical polarized waves. While the present invention has been described in terms of the preferred embodiments, the invention is not limited thereto, but can be embodied in various ways without departing from the principle of the invention as defined in the appended claims.

What is claimed is:

1. A polarization diversity antenna system comprising:

a first antenna configured to receive a first polarized wave;

a second antenna including a centerline and being configured to receive a second polarized wave, the second polarized wave being perpendicular to the first polarized wave; and a conductive circuit board on which the second antenna is provided, the conductive circuit board producing (i) a number of current portions when one of the first and second polarized waves is received, and (ii) including a centerline, the second antenna centerline being perpendicular to a lengthwise dimension of the conductive circuit board;

wherein the second antenna centerline is positioned proximate the conductive circuit board centerline and is generally longitudinally aligned therewith.

2. A polarization diversity antenna system as set forth in claim 1, wherein:

the conductive circuit board is rectangular, and the second antenna is provided symmetrically with respect to a center of the conductive circuit board in a longitudinal direction of the conductive circuit board.

3. A polarization diversity antenna system as set forth in claim 1, wherein the first antenna is provided on the conductive circuit board symmetrically with respect to a centerline.

4. A polarization diversity antenna system as set forth in claim 1, wherein the second antenna has a built-in antenna.

5. A polarization diversity antenna system as set forth in claim 1, wherein the second antenna has an inverted F antenna.

6. A polarization diversity antenna system as set forth in claim 1, wherein the second antenna has an inverse L antenna.

7. A polarization diversity antenna system as set forth in claim 1, wherein the second antenna has a loop antenna.

8. A polarization diversity antenna system as set forth in claim 1, wherein:

the conductive circuit board is rectangular, and the second antenna has a first antenna element and a second antenna element, the first antenna element and the second antenna element being provided on the conductive board symmetrically with respect to a center of the conductive circuit board in a longitudinal direction of the conductive circuit board.

9. A polarization diversity antenna system as set forth in claim 8, wherein the first and second antenna elements have substantially the same shape.

10. A polarization diversity antenna system as set forth in claim 8, wherein the second antenna has a built-in antenna.

11. A polarization diversity antenna system as set forth in claim 8, wherein the second antenna has an inverted F antenna.

12. A polarization diversity antenna system as set forth in claim 8, wherein the second antenna has an inverse L antenna.

13. A polarization diversity antenna system as set forth in claim 8, wherein the second antenna has an M-shaped antenna.

14. A polarization diversity antenna system as set forth in claim 8, wherein the second antenna has a loop antenna.

15. A polarization diversity antenna system as set forth in claim 1, wherein said second antenna centerline is positioned within 15% of the lengthwise dimension of said conductive circuit board relative to said circuit board centerline.

16. A polarization diversity antenna system for use in a portable telephone, the antenna system comprising:

a whip antenna configured to receive vertically polarized waves;

a built-in antenna configured to receive horizontally polarized waves, the built-in antenna including a centerline, the built-in antenna centerline being parallel to a lengthwise dimension of the built-in antenna; and a rectangular conductive circuit board on which the built-in antenna is mounted, the circuit board (i) producing a number of current portions when one of the vertically and horizontally polarized waves is received, and (ii) including a centerline, the circuit board centerline being perpendicular to a lengthwise dimension of the circuit board;

wherein the built-in antenna centerline is positioned proximate the circuit board centerline and is generally longitudinally aligned therewith.

17. A polarization diversity antenna system as set forth in claim 16, wherein said built-in antenna centerline is positioned within 15% of the lengthwise dimension of said circuit board relative to said circuit board centerline.

18. A portable telephone comprising:

a whip antenna configured to receive vertically polarized waves;

a built-in antenna configured to receive horizontally polarized waves, the built-in antenna including a centerline, the built-in antenna centerline being parallel to a lengthwise dimension of the built-in antenna;

a rectangular conductive circuit board on which the built-in antenna is mounted, the circuit board (i) producing a number of current portions when one of the vertically and horizontally polarized waves is received, and (ii) including a centerline, the circuit board centerline being perpendicular to a lengthwise dimension of the circuit board;

a switch circuit disposed on the board configured (i) to receive the vertically polarized waves and the horizontally polarized waves and (ii) to selectively output one of the vertically polarized waves and the horizontally polarized waves; and a receiver operatively arranged with the switch circuit and configured to receive the output therefrom;

wherein the built-in antenna centerline is positioned proximate the circuit board centerline and is generally longitudinally aligned therewith.

19. A polarization diversity antenna system as set forth in claim 18, wherein said built-in antenna centerline is positioned within 15% of the lengthwise dimension of said circuit board relative to said circuit board centerline.

* * * * *